US008336355B2

(12) United States Patent
Koo et al.

(10) Patent No.: US 8,336,355 B2
(45) Date of Patent: Dec. 25, 2012

(54) ROLL-FORMING SYSTEM AND METHOD THEREOF

(75) Inventors: Do-Hoi Koo, Ulsan (KR); Suek-Jun Choi, Busan (KR)

(73) Assignee: Sungwoo Hitech Co., Ltd., Busan (KR)

( * ) Notice: Subject to any disclaimer, the term of this patent is extended or adjusted under 35 U.S.C. 154(b) by 809 days.

(21) Appl. No.: 12/128,266

(22) Filed: May 28, 2008

(65) Prior Publication Data

US 2009/0165520 A1 Jul. 2, 2009

(30) Foreign Application Priority Data

Dec. 27, 2007 (KR) ..... 10-2007-0138944

(51) Int. Cl.
*B21D 5/14* (2006.01)
*B21D 28/00* (2006.01)

(52) U.S. Cl. ..... 72/168; 72/169; 72/405.01; 72/336

(58) Field of Classification Search ..... 72/166–169, 72/404, 405.01, 336, 337; 29/564
See application file for complete search history.

(56) References Cited

U.S. PATENT DOCUMENTS

| | | | | |
|---|---|---|---|---|
| 3,099,238 | A * | 7/1963 | Jones | 29/524 |
| 5,092,512 | A * | 3/1992 | Sturrus et al. | 72/168 |
| 5,934,544 | A * | 8/1999 | Lee et al. | 72/168 |
| 2002/0040525 | A1 * | 4/2002 | Himsl et al. | 29/897.2 |

FOREIGN PATENT DOCUMENTS

| | | |
|---|---|---|
| JP | 56-122620 | 9/1981 |
| JP | 04-127924 | 4/1992 |
| JP | 05-161921 | 6/1993 |
| KR | 10-0790773 | 12/2007 |

* cited by examiner

*Primary Examiner* — Dana Ross
*Assistant Examiner* — Pradeep C Battula
(74) *Attorney, Agent, or Firm* — Lexyoume IP Meister, PLLC.

(57) ABSTRACT

The present invention relates to a roll-forming system and a method thereof that enables both ends of a panel to be formed attractively by roll-forming the panel after cutting grooves are formed at both ends of the panel by using a blanking press.

10 Claims, 8 Drawing Sheets

ROLL-FORMING SYSTEM AND METHOD THEREOF

CROSS-REFERENCE TO RELATED APPLICATION

This application claims priority to and the benefit of Korean Patent Application No. 10-2007-0138944 filed in the Korean Intellectual Property Office on Dec. 27, 2007, the entire contents of which are incorporated herein by reference.

BACKGROUND OF THE INVENTION (a) Field of the Invention

The present invention relates to a roll-forming system and a method thereof. More particularly, the present invention relates to a roll-forming system and a method thereof that enables both ends of a panel to be formed attractively by roll-forming the panel after cutting grooves are formed at both ends of the panel by using a blanking press.

(b) Description of the Related Art

Generally, twenty to thirty thousand components are sequentially assembled to a vehicle body for manufacturing one vehicle, and particularly, a bumper beam, which is a part of the vehicle body, is assembled to front and rear portions of the vehicle body.

The bumper beam includes an impact-absorbing member for absorbing impact applied from the front or the rear, and a bumper cover covering the impact-absorbing member.

According to a conventional method for manufacturing the bumper beam, two rail members formed by press forming are welded to produce the bumper beam. Recently, a bumper beam has been manufactured by roll-forming a metal plate in order to improve productivity, and such a bumper beam includes a closed cross-section therein so as to absorb impact.

As shown in FIG. 1, a bumper beam 101 of a vehicle includes two closed cross-sections S therein. The bumper beam 101 is manufactured by roll-forming a metal plate to be symmetrical with reference to a middle portion thereof. The roll-forming is sequentially performed along a length direction of the metal plate, and the bumper beam 101 with a predetermined shape is thereby manufactured.

FIG. 2 is a schematic diagram showing a conventional roll-forming system and respective steps of a roll-forming method using the same.

According to the conventional roll-forming system and the roll-forming method by using the same, an uncoiler 201 for uncoiling a coil 200 is provided at a front portion in a process line, and performs an uncoiling step S110.

A straightener 203 for straightening the coil supplied from the uncoiler 201 to be a flat panel 250 is provided at the rear of the uncoiler 201 in the process line, and performs a straightening step S120.

In addition, a brake press 205 is provided at the rear of the straightener 203 in the process line. The brake press 205 performs a boring step S130 by boring a plurality of holes for assembling a main beam in the flat panel 250 supplied from the straightener 203.

A roll former unit 207 including a plurality of roll formers R1, R2, R3, R4, R5, R6, and R7 is provided at the rear of the brake press 205 in the process line. The roll former unit 207 performs a roll-forming step S140 by sequentially bending the flat panel 250 supplied through the uncoiler 201, the straightener 203, and the brake press 205 to be a predetermined-shaped beam.

A round bender 209 including at least one of curvature-forming rolls disposed at both sides thereof is provided at the rear of the roll former unit 207 in the process line. The shaped beam, having gone through the roll-forming step S140, passes through the round bender 209 and is bent to have a predetermined curvature. Thereby, a bending step S150 is performed.

In addition, a cutting press 211 for cutting the shaped beam with a closed cross-section to have a predetermined dimension is provided at the rear of the round bender 209 in the process line, and performs a cutting step S160.

A bumper beam 101 with a predetermined shape shown in FIG. 1 is manufactured by the conventional roll-forming system.

However, since both ends EP of the bumper beam 101 manufactured by the conventional roll-forming system have the same thickness T as the middle portion thereof, interference between the both ends EP of the bumper beam 101 and a bumper cover (not shown) may occur when the bumper beam 101 is assembled to a vehicle body. In addition, it is difficult to have sufficient space for preventing the interference between both ends EP of the bumper beam 101 and the bumper cover (not shown).

To solve such problems, both ends EP of the bumper beam 201 are pressed and the thickness T thereof is reduced so as to have sufficient space between the bumper cover, as shown in FIG. 3. Therefore, design freedom may be heightened and an attractive design of the bumper cover may be achieved.

In order to press the both ends EP of the bumper beam 201, a punch press 213 is provided at the rear of the cutting press 211 in the process line, and performs a forming step S170 of pressing both ends EP of the bumper beam 201 as shown in FIG. 2.

However, since tensile stress is primarily applied to the bumper beam 101 in the roll-forming step, the tensile stress applied to a most-deformed portion P thereof may be larger than a limit tensile stress when the tensile stress is secondarily applied to the both ends EP of the bumper beam 101 in the forming step S170 as shown in FIG. 4. Therefore, a crack or tear may occur at both ends EP of the bumper beam 101.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a roll-forming system and a method thereof having advantages of attractively forming both ends of a panel as a consequence of roll-forming the panel after a cutting groove is formed at both ends by using a blanking press and reducing thickness of both ends as a consequence of pressing both ends strongly.

A roll-forming system according to an exemplary embodiment of the present invention may include: an uncoiler provided at a front portion in a process line and uncoiling a coil; a straightener provided at the rear of the uncoiler in the process line and straightening the coil supplied from the uncoiler to be a flat panel; a brake press provided at the rear of the straightener in the process line and boring a plurality of holes for assembling a main beam on the panel supplied from the straightener; a roll former unit provided at the rear of the brake press in the process line and sequentially bending the panel supplied through the straightener and the brake press in order to form a predetermined-shaped beam; and a round bender provided at the rear of the roll former unit in the process line and having at least one curvature-forming roll bending the shaped beam to have a predetermined curvature, wherein a blanking press, which cuts the panel to have a predetermined dimension and forms at least one of cutting grooves respectively at both ends of the panel, is provided between the straightener and the brake press in the process line.

An inner surface of the cutting groove may be straight.

An inner surface of the cutting groove may be round.

In addition, two cutting grooves may be formed respectively at both ends of the panel.

A roll-forming method by using the roll-forming system may include: an uncoiling step where a coil is uncoiled; a straightening step where the coil having gone through the uncoiling step is straightened to be a flat panel; a blanking step where the flat panel having gone through the straightening step is cut to have a predetermined dimension and at least one of cutting grooves are formed at both ends of the panel; a boring step where a plurality of holes for assembling a main beam are bored in the panel having gone through the blanking step; a roll-forming step where the panel having gone through the boring step is sequentially bent in order to form a predetermined-shaped beam; and a bending step where the shaped beam having gone through the roll-forming step is bent to have a predetermined curvature.

An inner surface of the cutting groove may be straight.

An inner surface of the cutting groove may be round.

In addition, two cutting grooves may be formed respectively at both ends of the panel in the blanking step.

DETAILED DESCRIPTION OF THE EMBODIMENTS

Hereinafter, exemplary embodiments of the present invention will be described in detail with reference to the accompanying drawings.

Figure 1:
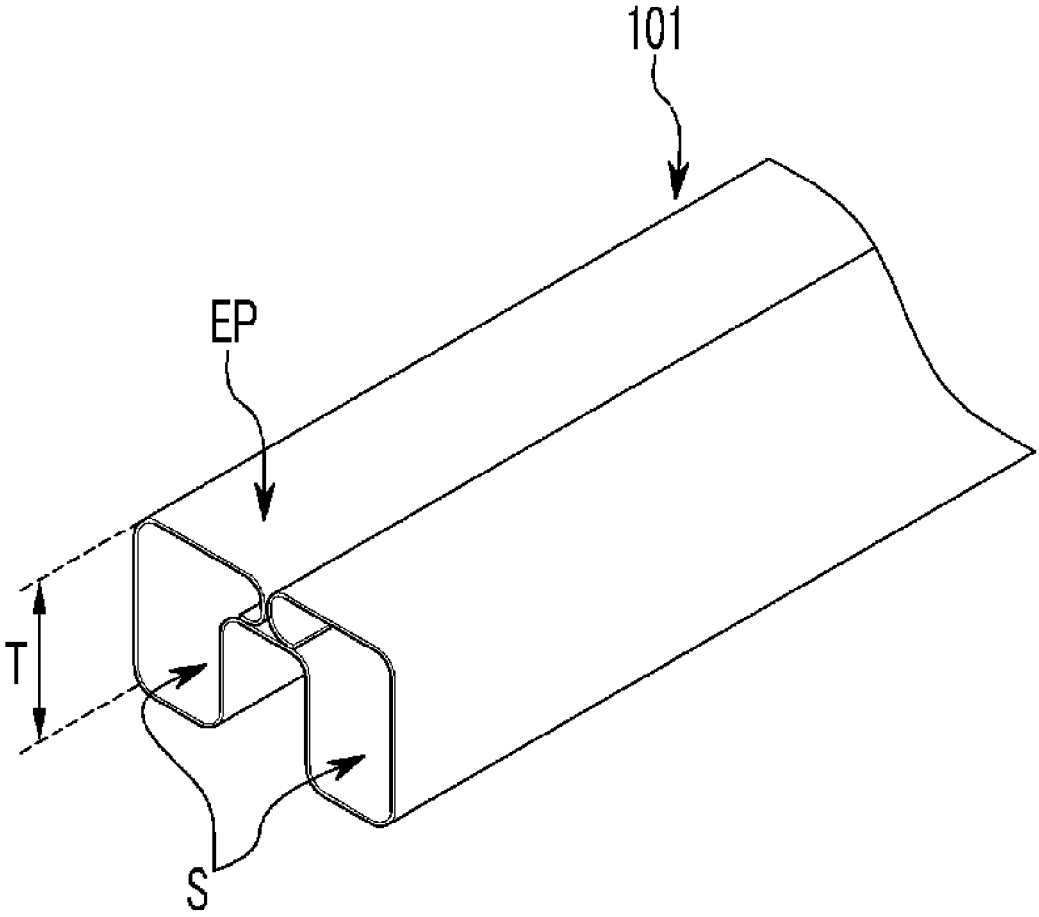
FIG. 1 is a perspective view showing a bumper beam of vehicles manufactured according to a conventional roll-forming method.
Figure 2:
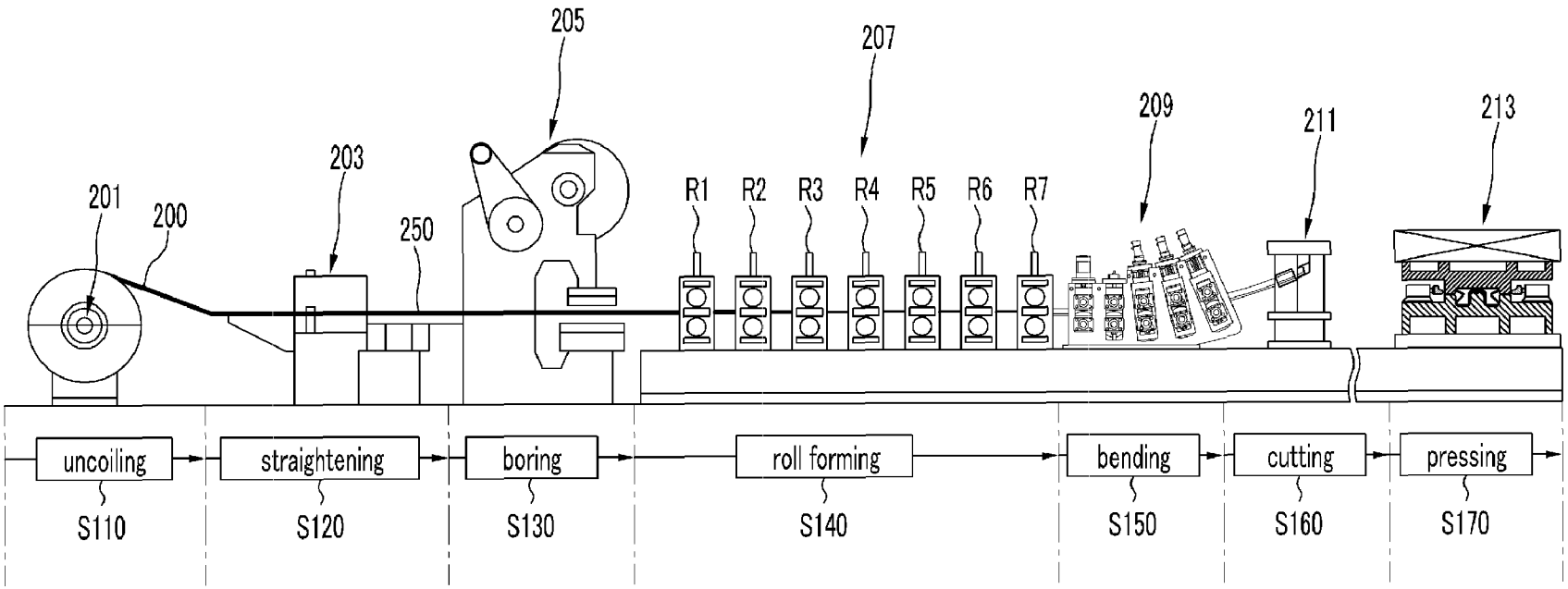
FIG. 2 is a schematic diagram showing a conventional roll-forming system and respective steps of a roll-forming method using the same.
Figure 3:
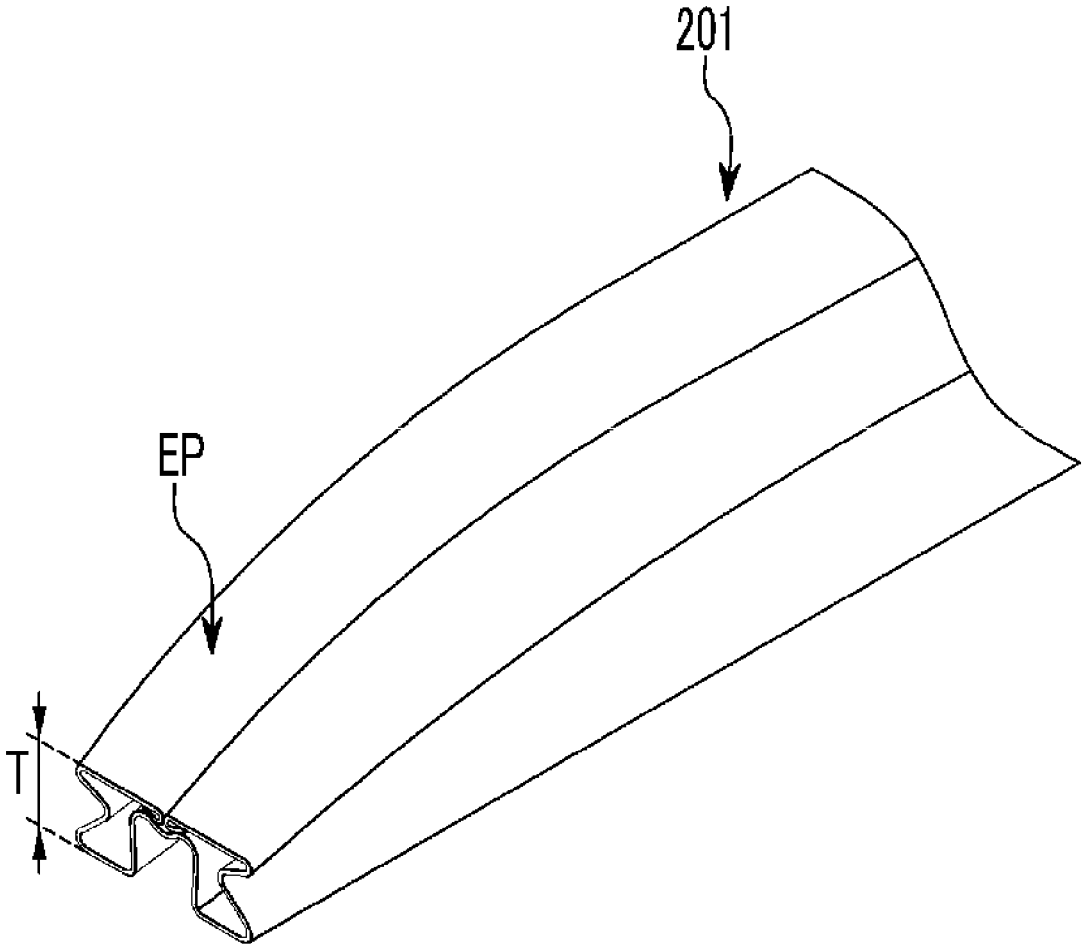
FIG. 3 is a perspective view showing one side end of a bumper beam of a vehicle manufactured by a conventional roll-forming system including a punch press.
Figure 4:
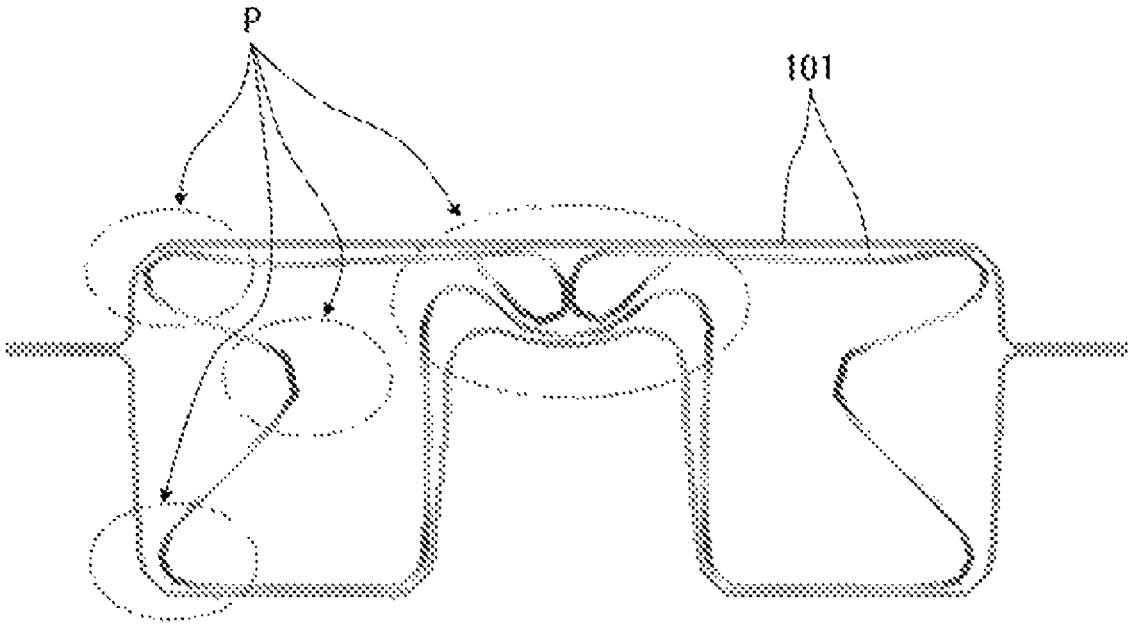
FIG. 4 is a cross-sectional view showing a bumper beam before being press formed and a bumper beam after being press formed when being manufactured by a conventional roll-forming system.
Figure 5:
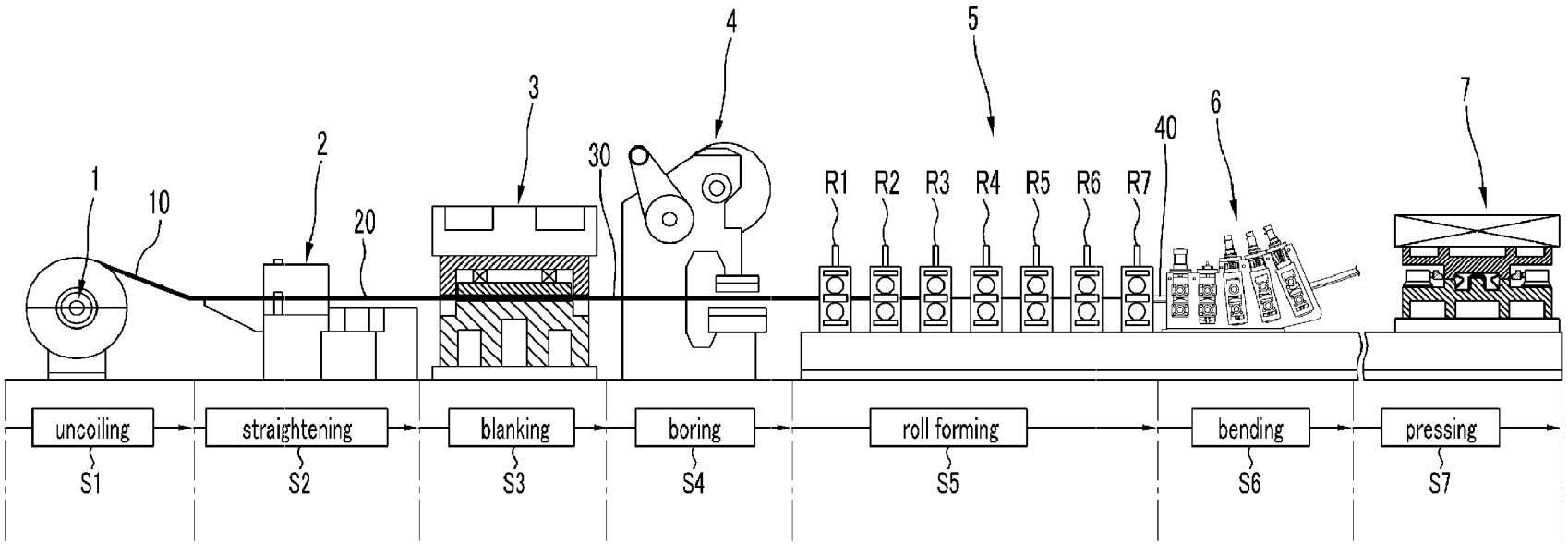
FIG. 5 is a schematic diagram showing a roll-forming system according to an exemplary embodiment of the present invention and respective steps of a roll-forming method using the same.
Figure 6:
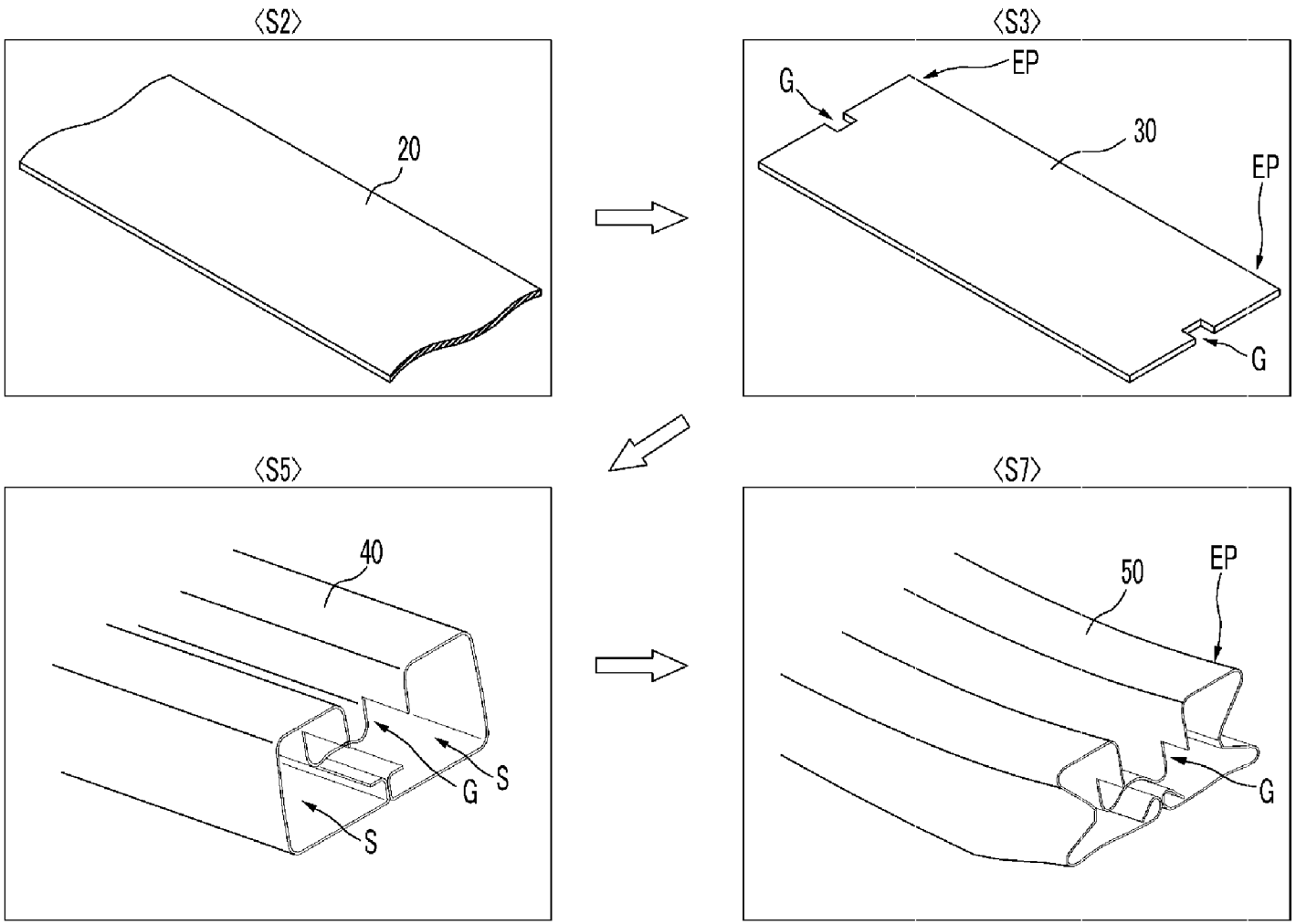
FIG. 6 is a schematic diagram showing a bumper beam in principal steps of a roll-forming method according to a first exemplary embodiment of the present invention.

FIG. 5 is a schematic diagram showing a roll-forming system according to an exemplary embodiment of the present invention and respective steps of a roll-forming method by using the same, and FIG. 6 is a schematic diagram showing a bumper beam in principal steps of a roll-forming method according to a first exemplary embodiment of the present invention.

As shown in FIG. 5, a roll-forming system according to an exemplary embodiment of the present invention includes an uncoiler 1, a straightener 2, a blanking press 3, a brake press 4, a roll former unit 5, and a round bender 6.

The uncoiler 1 is provided at a front portion in a process line, and uncoils a coil 10.

The straightener 2 is provided at the rear of the uncoiler 1 in the process line, and straightens the coil 10 supplied from the uncoiler 1 to be a flat panel 20.

The blanking press 3 is provided at the rear of the straightener 2 in the process line. The blanking press 3 cuts the flat panel 20 supplied from the straightener 2 to have a predetermined dimension, and forms at least one of cutting grooves G respectively at both ends of the panel 30.

An inner surface of the cutting groove G may be straight, as shown in FIG. 6.

The brake press 4 is provided at the rear of the blanking press 3 in the process line. The brake press 4 bores a plurality of holes for assembling a main beam in the panel 30 that is cut by the blanking press 3.

The roll former unit 5 is provided at the rear of the brake press 4 in the process line, and sequentially bends the panel 30 supplied through the straightener 2, the blanking press 3, and the brake press 4 in order to form a predetermined-shaped beam 40.

In the roll former unit 5, a plurality of roll formers R1, R2, R3, R4, R5, R6, and R7 are disposed in series.

The round bender 6 including at least one of curvature-forming rolls is provided at the rear of the roll former unit 5 in the process line, and bends the shaped beam 40 to have a predetermined curvature.

In order to manufacture a bumper beam 50 (refer to FIG. 6) by using the roll-forming system, an uncoiling step S1 where the coil 10 is uncoiled is performed by the uncoiler 1 provided at the front portion in the process line as shown in FIG. 5.

After the uncoiling step S1 is performed, a straightening step S2 where the coil 10 supplied from the uncoiler 1 is straightened to be the flat panel 20 shown in S2 of FIG. 6 is performed by the straightener 2 provided at the rear of the uncoiler 1.

After that, a blanking step S3 where the flat panel 20 having gone through the straightening step S2 is cut to have the predetermined dimension and at least one of cutting grooves G are formed at both ends of the panel 30 is performed by the blanking press 3 provided at the rear of the straightener 2.

At this time, the cutting groove G is formed at a middle portion of the both ends of the panel 30, and the inner surface of the cutting groove G is straight, as shown in S3 of FIG. 6.

A boring step S4 where the plurality of holes for assembling the main beam are formed in the panel 30 having gone through the blanking step S3 is then performed by the brake press 4 provided at the rear of the blanking press 3.

Then, a roll-forming step S5 where the panel 30 having gone through the boring step S4 is sequentially bent to be the shaped beam 40 having two closed cross-sections S shown in S5 of FIG. 6 is performed by the plurality of roll formers R1, R2, R3, R4, R5, R6, and R7 provided at the rear of the brake press 4.

Finally, a bending step S6 where the shaped beam 40 having gone through the roll-forming step S5 is bent to have the predetermined curvature is performed by the round bender 6 provided at the rear of the roll former unit 5.

Both ends EP of the shaped beam 40 manufactured according to the present invention are pressed so as to reduce the thickness T thereof, as shown in S7 of FIG. 6. Thereby, the bumper beam 50 is manufactured completely. The bumper beam 50 is manufactured by performing the additional forming step S7 by using a punch press 7, as shown in FIG. 5.

As shown in S3 of FIG. 6, the cutting grooves G are formed respectively at both ends EP of the panel 30 by the blanking press 3 in the blanking step S3. The roll-forming step S5 is performed by using the panel 30 having the cutting grooves G such that the shaped beam 40 having the cutting grooves G is formed, as shown in S5 of FIG. 6.

When the bumper beam 50 shown in S7 of FIG. 6 is manufactured by pressing both ends EP of the shaped beam 40, tensile stress is secondarily applied to both ends EP in a state in which the tensile stress is primarily applied to both ends EP in the roll-forming step S5. However, since the tensile stress is applied to both ends EP after a most-deformable portion is removed by forming the cutting grooves G, a crack or tear may not occur at the ends EP.

Figure 7:
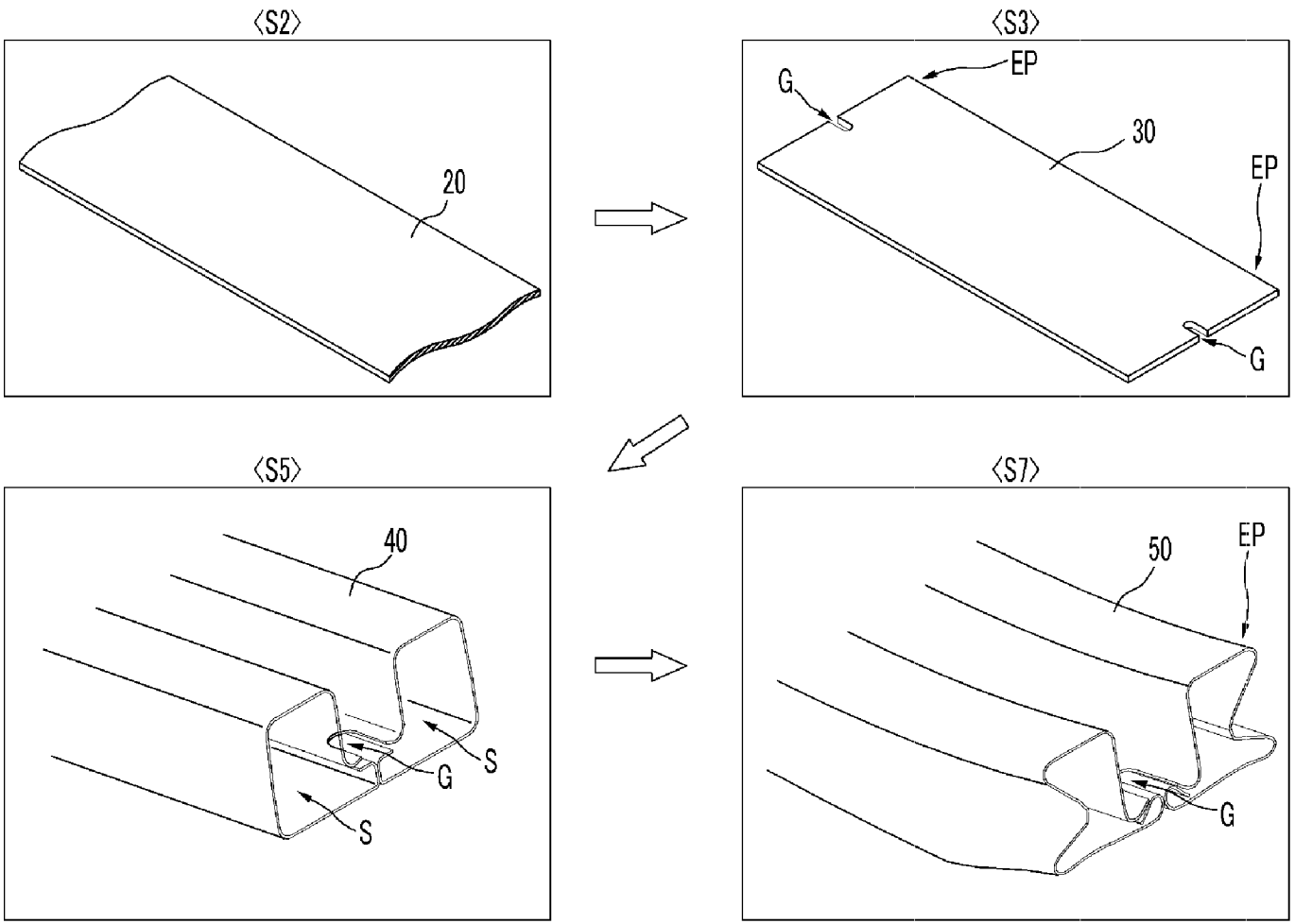
FIG. 7 is a schematic diagram showing a bumper beam in principal steps of a roll-forming method according to a second exemplary embodiment of the present invention.
Figure 8:
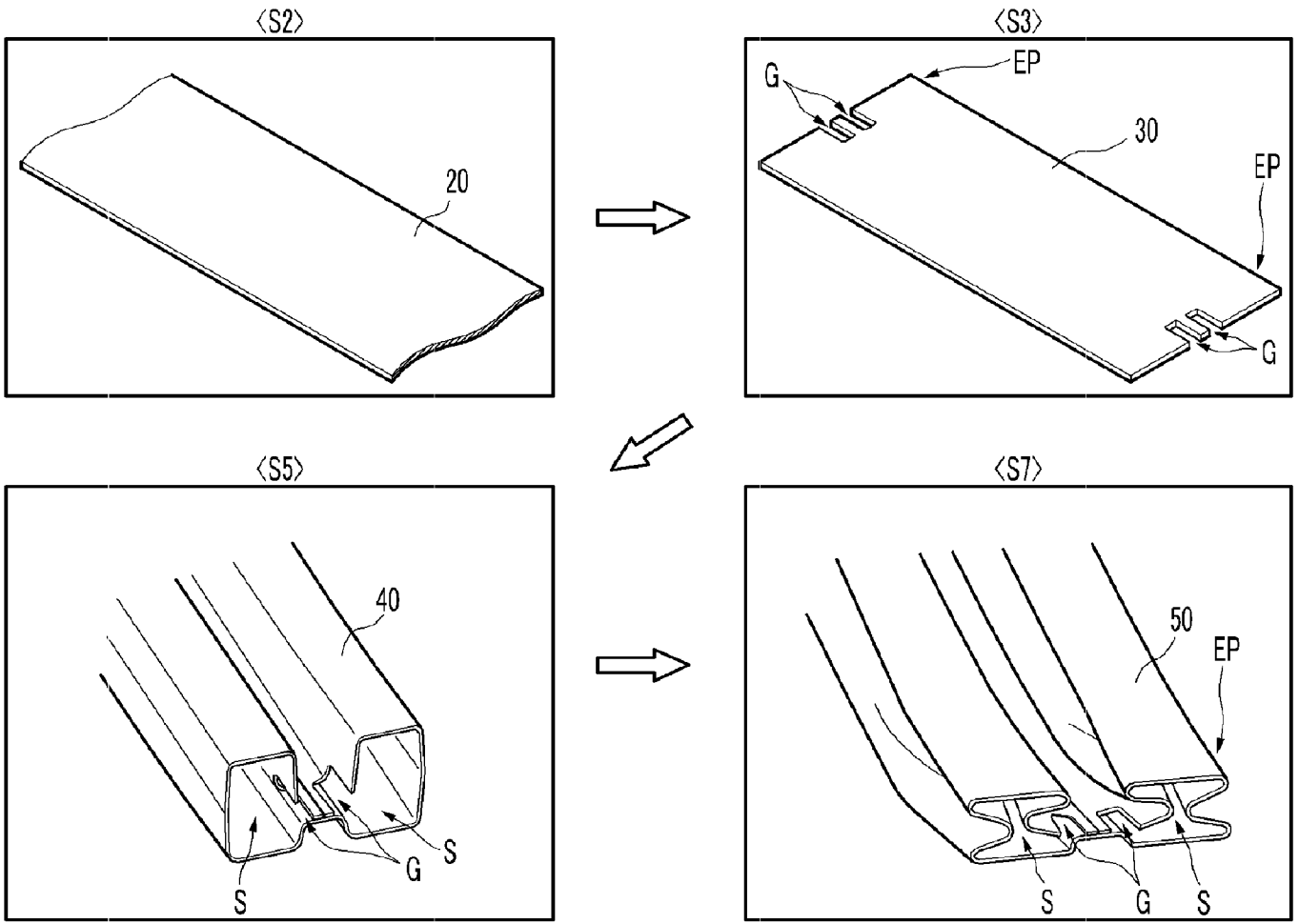
FIG. 8 is a schematic diagram showing a bumper beam in principal steps of a roll-forming method according to a third exemplary embodiment of the present invention.

FIG. 7 is a schematic diagram showing a bumper beam in principal steps of a roll-forming method according to a second exemplary embodiment of the present invention, and FIG. 8 is a schematic diagram showing a bumper beam in principal steps of a roll-forming method according to a third exemplary embodiment of the present invention.

As shown in FIG. 7 and FIG. 8, roll-forming methods according to the second and third exemplary embodiments of the present invention are similar to the roll-forming method according to the first exemplary embodiment of the present invention, except the shape and number of cutting grooves G formed in the blanking step S3. Therefore, only the shape and number of cutting grooves are described.

According to the second exemplary embodiment of the present invention, the inner surface of the cutting groove G formed in the blanking step S3 may be rounded, as shown in S3 of FIG. 7.

According to the third exemplary embodiment of the present invention, two cutting grooves G are formed respectively at the middle portion of both ends of the panel 30 in the blanking step S3, as shown in S3 of FIG. 8.

Here, three exemplary embodiments are mainly described, but other embodiments that are different from the exemplary embodiments in the shape and number of cutting grooves G can be imagined. However, these other embodiments must be included in the range of the present invention.

According to the present invention, cutting grooves are formed at both ends of a panel by a blanking press before the panel is supplied to a roll former unit. Thus, the both ends of the bumper beam may be formed attractively, and the thickness of both ends may be reduced by pressing both ends of the bumper beam strongly.

In addition, according to the present invention, a cutting step where a shaped beam is cut to have a predetermined dimension may be eliminated.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A roll-forming system comprising:

an uncoiler provided at a front portion in a process line and uncoiling a coil;

a straightener provided at the rear of the uncoiler in the process line and straightening the coil supplied from the uncoiler to be a flat panel;

a blanking press provided at the rear of the straightener in the process line, wherein (a) the blanking press is configured to cut the flat panel into a separated sheet, (b) the blanking press is further configured to form a first cutting groove on a first edge of the separated sheet and a second cutting groove on a second edge of the separated sheet, and (c) the first and second edges of the separated sheet are opposite each other;

a brake press provided at the rear of the blanking press in the process line and boring a plurality of holes for assembling a main beam in the separated sheet supplied from the blanking press;

a roll former unit provided at the rear of the brake press in the process line for sequentially bending the separated sheet supplied through the blanking press and the brake press in order to form a predetermined-shaped beam, wherein (a) sequentially bending the separated sheet includes bending the separated sheet along a bending line that extends between the first and second edges of the separated sheet and (b) the bending line connects the first and second cutting grooves;

a round bender provided at the rear of the roll former unit in the process line and having at least one of curvature-forming rolls bending the shaped beam to have a predetermined curvature; and a punch press disposed at the rear of the round bender and adapted to reduce a thickness of at least a portion of the shaped beam so as to manufacture a bumper beam.

2. The roll-forming system of claim 1, wherein an inner surface of the first cutting groove is straight, and an inner surface of the second cutting groove is straight.

3. The roll-forming system of claim 2, wherein two first cutting grooves are formed on the first edge of the separated sheet, and two second cutting grooves are formed on the second edge of the separated sheet.

4. The roll-forming system of claim 1, wherein an inner surface of the first cutting groove is rounded, and an inner surface of the second cutting groove is rounded.

5. The roll-forming system of claim 4, wherein two first cutting grooves are formed on the first edge of the separated sheet, and two second cutting grooves are formed on the second edge of the separated sheet.

6. A roll-forming method comprising:

an uncoiling step where a coil is uncoiled;

a straightening step where the coil having gone through the uncoiling step is straightened to be a flat panel;

a blanking step where the flat panel having gone through the straightening step is cut to have a predetermined dimension, wherein (a) a first cutting groove is formed along a first edge of the panel, (b) a second cutting groove is formed along a second edge of the panel, and (c) the first and second edges of the panel are opposite each other;

a boring step where a plurality of holes for assembling a main beam are bored in the panel having gone through the blanking step;

a roll-forming step where the panel having gone through the boring step is sequentially bent in order to form a predetermined-shaped beam, wherein (a) sequentially bending the panel includes bending the panel along a bending line that extends between the first and second edges of the panel and (b) the bending line connects the first and second cutting grooves;

a bending step where the shaped beam having gone through the roll-forming step is further bent to have a predetermined curvature; and a pressing step where the first and second edges of the shaped beam are pressed so as to reduce a thickness of at least a portion of the shaped beam and manufacture a bumper beam.

7. The roll-forming method of claim 6, wherein an inner surface of the first cutting groove is straight, and an inner surface of the second cutting groove is straight.

8. The roll-forming method of claim 7, wherein two first cutting grooves are formed on the first edge of the panel, and two second cutting grooves are formed on the second edge of the panel.

9. The roll-forming method of claim 6, wherein an inner surface of the first cutting groove is rounded, and an inner surface of the second cutting groove is rounded.

10. The roll-forming method of claim 6, wherein two first cutting grooves are formed on the first edge of the panel, and two second cutting grooves are formed on the second edge of the panel.

* * * * *